US009514878B2

(12) United States Patent
Nakatsu et al.

(10) Patent No.: US 9,514,878 B2
(45) Date of Patent: Dec. 6, 2016

(54) COIL AND MANUFACTURING METHOD FOR SAME, AND REACTOR

(71) Applicant: TAMURA Corporation, Tokyo (JP)

(72) Inventors: Ryo Nakatsu, Tokyo (JP); Toshikazu Ninomiya, Tokyo (JP); Kensuke Maeno, Tokyo (JP); Masashi Yamada, Tokyo (JP); Ryotaro Tanaka, Tokyo (JP)

(73) Assignee: TAMURA Corporation, Tokyo (JP)

( * ) Notice: Subject to any disclaimer, the term of this patent is extended or adjusted under 35 U.S.C. 154(b) by 0 days.

(21) Appl. No.: 14/550,416

(22) Filed: Nov. 21, 2014

(65) Prior Publication Data

US 2015/0162119 A1 Jun. 11, 2015

(30) Foreign Application Priority Data

Nov. 22, 2013 (JP) ..... 2013-242357
Nov. 22, 2013 (JP) ..... 2013-242399
Oct. 31, 2014 (JP) ..... 2014-223800

(51) Int. Cl.

*H01F 27/30* (2006.01)
*H01F 27/24* (2006.01)
*H01F 27/32* (2006.01)
*H01F 27/28* (2006.01)
*H01F 27/40* (2006.01)

(52) U.S. Cl.

CPC ..... *H01F 27/323* (2013.01); *H01F 27/306* (2013.01); *H01F 27/2852* (2013.01); *H01F 27/402* (2013.01); *H01F 2027/406* (2013.01); *Y10T 29/4902* (2015.01)

(58) Field of Classification Search

CPC ..... Y10T 29/2902; H01F 5/06; H01F 5/02; H01F 27/40; H01F 27/306; H01F 27/323; H01F 27/2852; H01F 27/402; H01F 27/2847; H01F 41/04; H01F 2027/406
USPC ..... 336/105, 198, 205, 208, 212
See application file for complete search history.

(56) References Cited

U.S. PATENT DOCUMENTS 4,477,790 A * 10/1984 Moritz ..... H01F 27/322 29/602.1
2012/0268232 A1* 10/2012 Yamada ..... H01F 27/2823 336/222
2013/0099887 A1* 4/2013 Yamamoto ..... H01F 30/06 336/220

FOREIGN PATENT DOCUMENTS

| | | | |
|---|---|---|---|
| JP | H06-56336 | B2 | 7/1994 |
| JP | 2009-200387 | A | 9/2009 |
| JP | 2009-261086 | A | 11/2009 |
| JP | 2011-023561 | A | 2/2011 |
| JP | 2012-238634 | A | 12/2012 |
| JP | 2012-243913 | A | 12/2012 |
| WO | 2008/096526 | A1 | 8/2008 |

* cited by examiner

*Primary Examiner* — Mangtin Lian
(74) *Attorney, Agent, or Firm* — Osha Liang LLP

(57) ABSTRACT

A coil includes a coil unit provided with a wire and a self-melting layer formed on surfaces of the wire, and a resin member affixed to the resin member by the self-melting layer.

10 Claims, 18 Drawing Sheets

COIL AND MANUFACTURING METHOD FOR SAME, AND REACTOR

FIELD OF THE INVENTION

The present invention relates generally to a coil formed by wounding wire forming a self-melting layer on a surface, a manufacturing method for same, and a reactor.

BACKGROUND ART

Edgewise coils are coils in which the short side of the flat wire is wound vertically onto an inner diameter face. The cross-sectional area of the area is therefore larger than that of coils in which round wire is wound, since the cross-section is angular. Moreover, since they are wound in a single layer, unlike round wire, which is wound in multiple layers, there is little temperature differential between the inside and the outside of the wire, giving the coil excellent heat-releasing properties with little temperature rise. Thanks to these advantages, such coils are therefore suited for use in high-efficiency reactors.

Conventionally known examples of edgewise coils include self-melting edgewise coils in which a self-melting layer is formed comprising a heat-curing resin on the surface of flat wire or flat braided wire, the wire is then wound into a coil which is heated, thereby turning the wire into a single unit (Japan Patent Application Publication No. 2009-200387 A, Japan Patent Application Publication No. 2009-261086 A). In this case "self-melting" means that the wire is simply heated to melt the resin formed on the surface of the wire itself and adhere adjacent segments of wire together, without the need to use any other adhesive or molding resin. Resins which form a self-melting layer include phenol resins, epoxy resins, polyimide resins, resins in which part of the epoxy resin is transformed into phenol resin, and so on.

Compared to conventional art, in which flat wire is wound into a coil and made into a single unit by impregnating it in or molding it with resin, self-melting edgewise coil uses flat wire which has a self-melting layer, making it possible to eliminate the complexity of the steps involved in impregnation, and the risk of damaging the covering of the wire during molding.

Edgewise coils in which flat wire with a self-melting layer is wound are subject to little tightening force (residual stress), and there is therefore little pressure in the direction of adhesion between segments of wire during the melting (i.e., pressure acting in the axial direction of the coil), which makes it impossible to adhere the wire segments together fully simply by heating the coil. Therefore, in the above Patent Literature a technique is proposed whereby adjacent wire segments are adhered together by applying pressure to the wound coil, which has been set in a mold or the like, in the axial direction thereof.

However, in conventional art, pressure is applied to the wound coil in a direct-contact mold, which causes the self-melting layer on the surface of the wire to become attached to the mold, and this is difficult to remove from the mold. Furthermore, since edgewise coil is not used alone but as a component in reactors and other electronic parts in combination with cores, bobbins, and so on, using the self-melt on the coil alone to make it into a single unit and then attempting to combine it with a core or a bobbin increases the manufacturing steps of the final electronic part. For example, the number of manufacturing steps increases by the number of steps involved in adhering the coil to parts other than the coil, e.g., using an adhesive or the like.

The difficulty involved in removing the coil from the mold and the increase in the number of manufacturing steps are present in other coils, and not just limited to edgewise coils.

SUMMARY OF THE INVENTION

In one aspect, one or more embodiments of the present invention can reduce the difficulty involved in removing the coil from the mold and also reduce the number of steps in manufacturing the coil.

According to one or more embodiments, a coil may comprise a coil unit provided with a wire and a self-melting layer formed on surfaces of the wire, and a resin member affixed to the wire, wherein the wire is adhered and affixed to the resin member by the self-melting layer.

According to one or more embodiments, a method for manufacturing a coil may comprise a coil unit provided with a wire and a self-melting layer formed on surfaces of the wire, and a resin member affixed to the wire, wherein the coil unit is pressed against the resin member, the self-melting layer is heated and melted, and the wire is adhered and affixed to the resin member.

According to one or more embodiments, a coil may comprise a coil unit provided with a wire and a self-melting layer formed on surfaces of the wire, and an electronic part affixed to the surface of the coil unit by the self-melting layer.

DETAILED DESCRIPTION OF EMBODIMENTS

Figure 1:
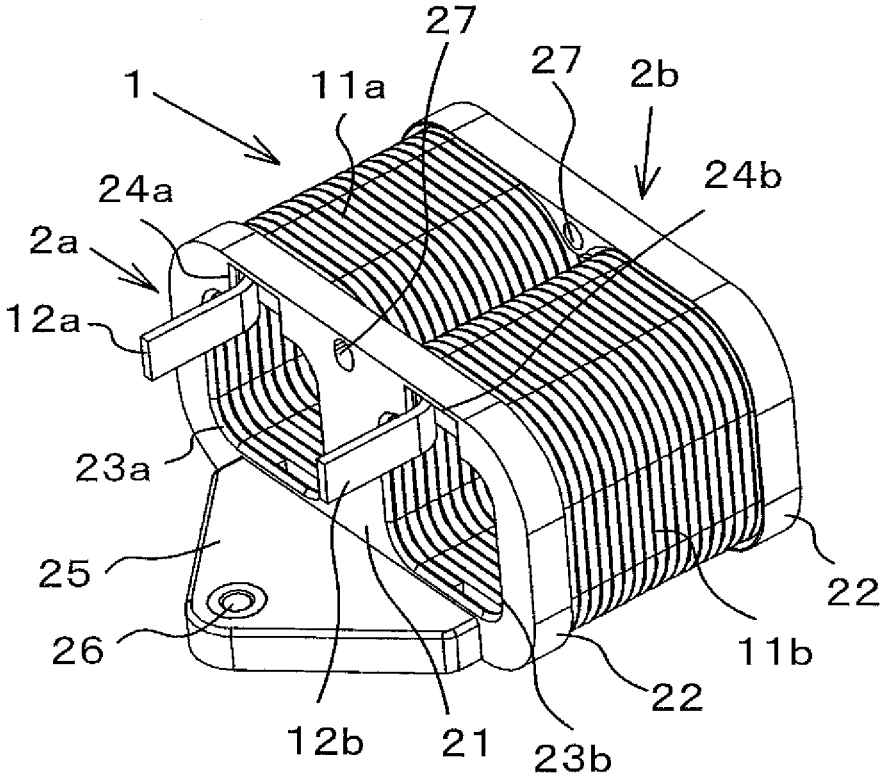
FIG. 1 is an oblique view of edgewise coil according to one or more embodiments of the present invention.

According to one or more embodiments of, a coil, a method for manufacturing same, and a reactor are provided, wherein an operation of melting and adhering wire can be done simply and without a self-melting layer becoming attached to a mol during application of pressure, and moreover an electronic part such as a reactor can be manufactured easily by combining the coil, in which the wire has been made into a single unit by the melting, with a core or a bobbin.

For example, according to one or more embodiments of a coil having the following features or a method for manufacturing that coil is provided.

(1) A coil unit provided with a wire and a self-melting layer formed on surfaces of the wire.

(2) A resin member affixed to the wire.

(3) The wire is adhered and affixed to the resin member by the self-melting layer.

Furthermore, according to one or more embodiments of a coil having the following features or a method for manufacturing that coil is provided.

(4) The coil unit is anti edgewise coil in which flat wire, which is the wire, is wound.

(5) The resin member is adhered to an axial-direction end of the coil unit.

(6) With the resin member mounted on the coil unit, pressure is applied to the coil unit via the resin member in the axial direction of the coil unit.

(7) The self-melting layer on the surface of the flat wire is heated and melted, and adjacent segments of the wound flat wire adhere to one another.

It is also possible that a protruding portion which protrudes from the surface of the flat wire is formed on at least one part of the coil unit, and a portion of the protruding portion is adhered to an adjacent segment of the flat wire by the self-melting layer.

It is also possible that a protruding portion which protrudes from the surface of the flat wire is formed on at least one part of the coil unit, and the protruding portion is crushed by pressure being applied in an axial direction of the coil unit after winding the flat wire, and adjacent segments of the flat wire are adhered by the self-melting layer.

It is also possible that a protruding portion which protrudes from the surface of the flat wire is formed on at least one part of an inner circumference of a bend in the coil unit, and the protruding portion is crushed by pressure being applied in an axial direction of the coil unit after winding the flat wire, and adjacent segments of the flat wire are adhered by the self-melting layer.

It is also possible that the coil unit is formed by winding flat wire, which has a flat surface, such that the flat surfaces confront one another, and adjacent segments of the flat wire are adhered on at least part of the flat surfaces by the self-melting layer.

The resin member can be provided with through portions for a connection terminal protruding from an end of the coil unit or an affixing portion for a core inside the coil unit or a resin member integrated with the core.

A reactor using a coil according to one or more embodiments of the present invention is a reactor having any of constitutions (1) to (3) above and the following constitutions.

(8) A core is embedded inside the resin member.

(9) A positioning portion which positions an end of the coil unit is provided to a surface of the resin member in which the core is embedded.

A reactor using a coil according to one or more embodiments of the present invention may have the following constitutions.

(10) The self-melting layer of the end of the wire is adhered to the positioning portion and the wire of the coil unit is affixed to the resin member.

(11) The positioning member is a pair of protrusions protruding from the surface of the resin member, ends of the wire of the coil unit are sandwiched between the pair of protrusions, and the self-melting layer is adhered to the protrusions.

A reactor using a coil according to one or more embodiments of the present invention is a reactor having any of constitutions (1) to (3) above and the following constitutions.

(12) A core is embedded inside the resin member.

(13) And end face of the coil unit is adhered to the resin member by the self-melting layer.

Furthermore, it is possible that a coil according to one or more embodiments of the present invention has the electronic part between the resin member and the coil unit. It is also possible that a recess into which the electronic part is mounted is formed in a location of the resin member where the electronic part is to be disposed. Furthermore, it is also possible that the resin member is inserted into the coil unit and an electronic part is disposed between the outer circumference of the resin member and the inner circumference of the coil.

This obviates the need for separate adhesive or filler, and the electronic part can be affixed to the coil unit with ease. Moreover, if the electronic part and the coil unit are affixed to one another concurrently with the process of making the wires of the coil a single unit using the self-melting layer, the number of overall process steps for the coil can be reduced.

Thus, according to one or more embodiments of an electronic part such as a reactor can easily be manufactured by combining a core or the like with a coil unit having a self-melting layer on surfaces of wires. Furthermore a reactor can be provided whereby entry of foreign matter between wire segments can be effectively prevented by performing melting with the coil subjected to pressure in an axial direction, since there are therefore fewer gaps between the wire segments, which are therefore tighter together.

1. First Embodiment

A first embodiment of the present invention is described in detail below, with reference to FIGS. 1 through 5.

(1) Constitution

An edgewise coil of the present embodiment is constituted by a cylindrical coil unit 1 in which flat wire on a surface of which a self-melting layer is formed is wound in a square shape, and first and second resin members (called coil-side resin members) 2*a* and 2*b* which are mounted on both axial-direction end faces of the coil unit 1. Resin ordinarily used in self-melting layers can be used as the resin constituting the self-melting layer, but a resin in which a inciting film comprising a main epoxy agent and a curing agent is in a semi-cured state can be used. The coil-side resin members 2*a* and 2*b* comprise materials which have greater heat resistance than the adhesion temperature of the self-melting layer, such as PPS (polyphenylsulfide) resin, for example.

The coil unit 1 is provided with a pair of left and right winding portions 11*a* and 11*b*, lead-out portions 12*a* and 12*b* which protrude in an axial direction from first ends of the winding portions 11*a* and 11*b*, and a connection portion 13 which is disposed between second ends of the winding portions 11*a* and 11*b*. In the present embodiment the lead-out portions 12*a* and 12*b* and the connection portion 13 are formed as a single unit with the winding portions 11*a* and 11*b* by bending a single flat wire, but it is also possible to form the winding portions 11*a* and 11*b* separately as two cylinders and join by welding or the like short lead lines prepared separately to the winding portions 11*a* and 11*b*, and thereby provide the lead-out portions 12*a* and 12*h* and the connection portion 13.

A first coil-side resin member 2*a* is mounted on the coil unit 1 on the side where the lead-out portions 12*a* and 12*b* are. The first coil-side resin member 2*a* is provided with an end plate 21 which covers a rounded-corner rectangle (also called a track shape) which covers an end face of the coil unit 1, and an edge plate 22 which protrudes towards the coil unit 1 from the end plate 21 The end plate 21 is provided with openings 23*a* and 23*b* for inserting cores of a reactor into the pair of left and right winding portions 11*a* and 11*b*, and cutouts 24*a* and 24*b* for inserting the lead-out portions 12*a* and 12*b* above that. In other words, the cutouts 24*a* and 24*b* are through-holes through which pass the lead-out portions 12*a* and 12*b* which protrude from the end of the coil unit 1. Because part of the cutouts 24*a* and 24*b* are provided to part of the end plate 21, the lead-out portions 12*a* and 12*b* can be reeled out, making it possible to minimize exposure of the end of the coil unit 1.

A triangular bracket 25 which protrudes parallel to the coil unit 1 but in the opposite direction is provided to a bottom edge of the end plate 21 (opposite the lead-out portions 12*a* and 12*b*). The tip of the bracket 25 (the apex of the triangle) is provided with a screw hole 26 used for affixing the core-side resin member during assembly of the reactor. A recess 27, used when positioning the core-side resin member, is provided to a top central portion of the end plate 21.

A second coil-side resin member 2*b* has the same structure as the first coil-side resin member 2*a*, provided with its own rounded-corner end plate 21, edge plate 22, openings 23*a* and 23*b*, and recess 27.

(2) Manufacturing Method

The edgewise coil of the present embodiment is manufactured as follows.

Figure 2:
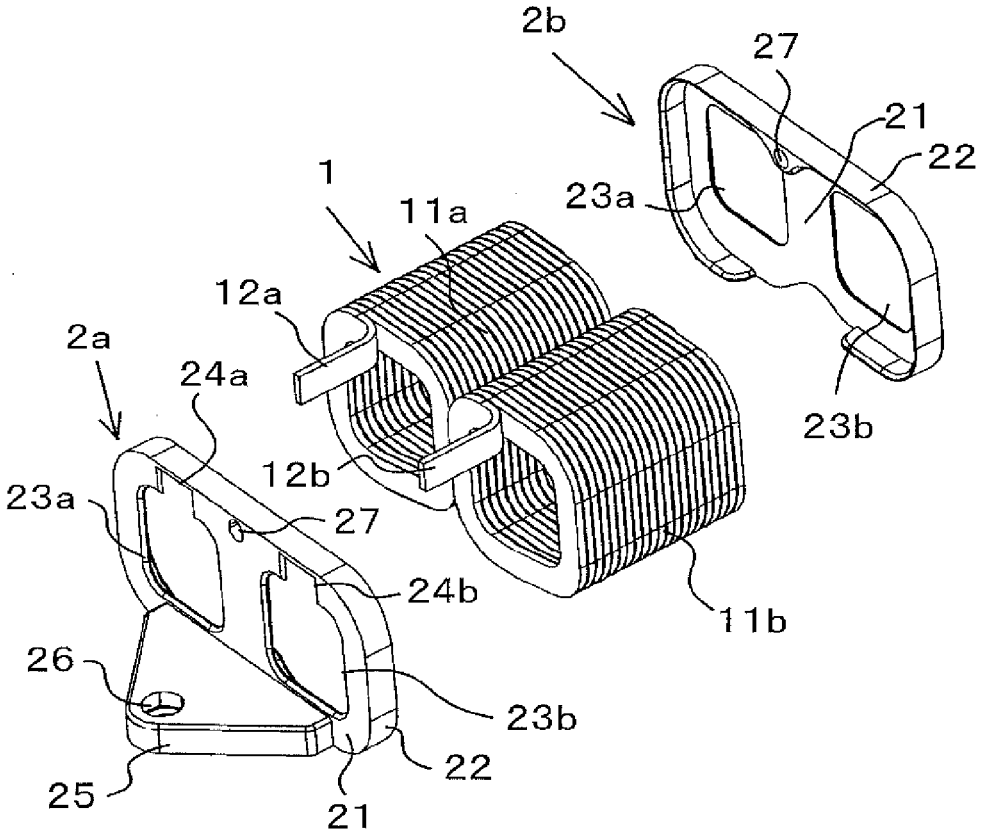
FIG. 2 is an exploded oblique view of edgewise coil according to one or more embodiments of the present invention.
Figure 3:
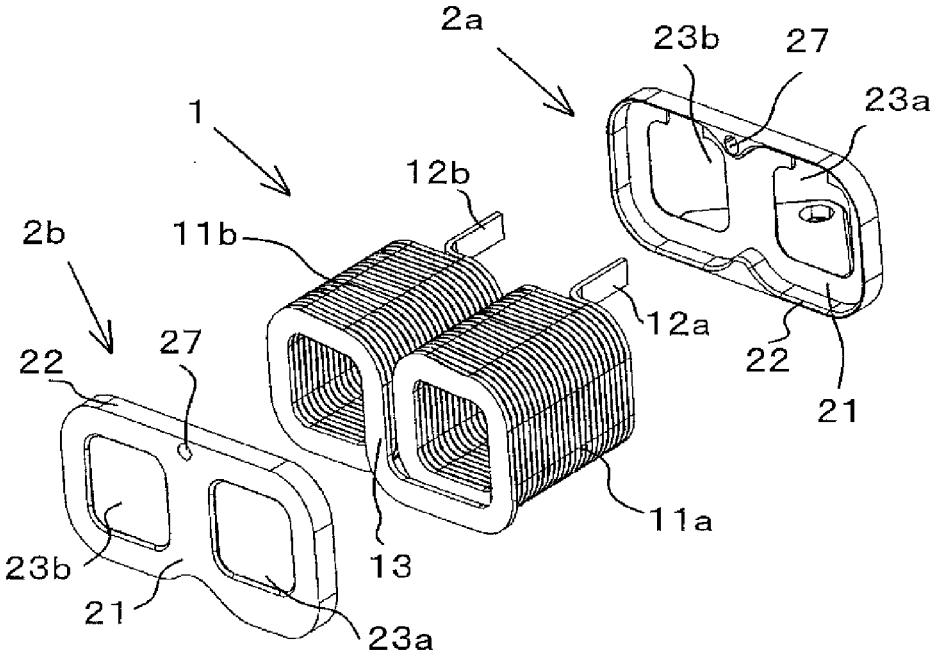
FIG. 3 is an exploded oblique view of the edgewise coil in FIG. 2 seen from the opposite side.

First, the coil unit 1 is formed, having the left and right winding portions 11*a* and 11*b* and the lead-out portions 12*a* and 12*b* as shown in FIGS. 2 and 3 by winding flat wire with a self-melting layer formed on surfaces thereof in an edgewise manner. Winding of the flat wire is done at room temperature, so that the self-melting layer on the surface does not melt, causing adjacent segments of the flat wire to adhere to one another. A publicly known technique can be used as appropriate for winding the flat wire in an edgewise manner, such as that disclosed in WO 2008/096526 A1.

After forming the coil unit 1, the coil-side resin members 2*a* and 2*b* are placed over both ends thereof, and pressure is applied to the coil unit 1 along the axial direction thereof while it is in a heated atmosphere of 170 to 200° C. The mold or other force-applying jig is caused to abut the coil-side resin members 2*a* and 2*b* in this case, thereby preventing the force-applying jig from coming in contact with the coil unit 1. When pressure is applied to the coil unit 1 in a heated atmosphere, the resin constituting the self-melting layer melts, which causes adjacent segments of the flat wire to adhere to one another by means of the melted resin, turning the entire coil into a single unit.

The coil-side resin members 2*a* and 2*b* in the present embodiment are constituted by PPS resin, which has a melting point of around 280° C., and therefore has good heat resistance and is not affected by the melting temperature of the self-melting layer. Therefore, the force-applying jig which comes in contact with the coil-side resin members 2*a* and 2*b* can easily separate from the surface of the coil-side resin members 2*a* and 2*b* after pressure has been applied, despite having melted the self-melting layer of the coil unit 1. On the other hand, because the coil unit 1 and the coil-side resin members 2*a* and 2*b* have been adhered to one another by the self-melting layer of the coil unit 1, post-pressure handling is easy.

(3) Constitution of the Reactor

Figure 4:
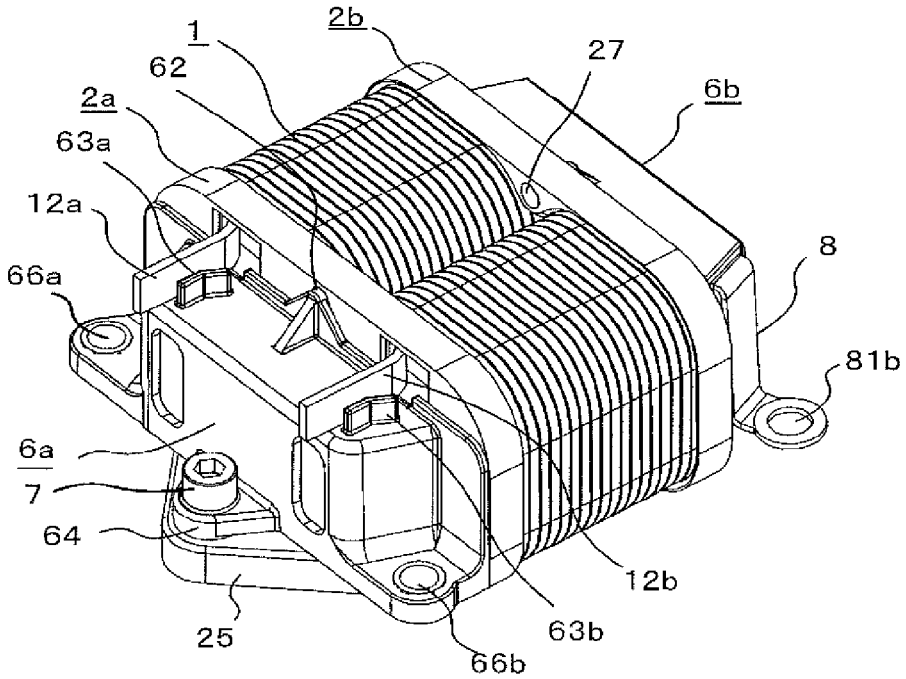
FIG. 4 is an oblique view of a reactor incorporating the edgewise coil according to one or more embodiments of the present invention.
Figure 5:
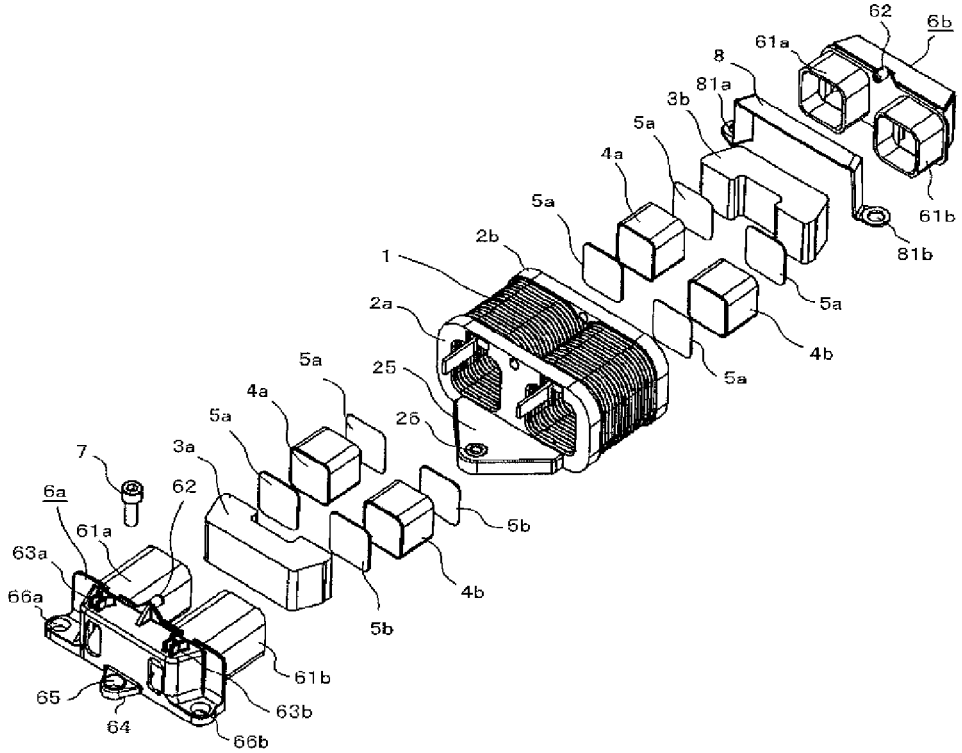
FIG. 5 is an exploded oblique view of a reactor incorporating the edgewise coil according to one or more embodiments of the present invention.

A reactor using the edgewise coil of the present embodiment is described now, with reference to FIGS. 4 and 5. This reactor is constituted by the edgewise coil of the present embodiment made up of the coil unit 1 and the coil-side resin members 2*a* and 2*b*, an annular core made of a magnetic material, and resin members which cover the annular core (also called core-side resin members).

In the annular core, first and second C-shaped yoke portions 3*a* and 3*b* and two each of left and right block leg portions 4*a* and 4*b* connecting these are connected in a ring shape with spacers 5*a* and 5*b* interposed therebetween. The first and second yoke portions 3*a* and 3*b* are embedded inside first and second core-side resin members 6*a* and 6*b* using a molding method. While inserted into cylindrical bobbins 61*a* and 61*b* which are provided to the first and second core-side resin members 6*a* and 6*b*, the left and right block leg portions 4*a* and 4*b* pass through the openings 23*a* and 23*b* of the coil-side resin members 2*a* and 2*b* and enter into the winding portions 11*a* and 11*b* of the coil unit 1.

A pin 62 protruding horizontally towards the edgewise coil is provided in the top center of the second core-side resin member 6*a*, the pin 62 is inserted into the recess 27 of the coil-side resin member 2*a* to perform positioning of the top of the core-side resin member 6*a* and the coil-side resin member 2*a*. Groove-shaped guides 63*a* and 63*b* are provided above and to the left and right of the first core-side resin member 6*a* in positions matching the lead-out portions 12*a* and 12*b* of the coil unit 1, and the lead-out portions 12*a* and 12*b* are inserted thereinto. In other words, grooves are formed into which the lead-out portions 12*a* and 12*b* are inserted by two guides. The guides 63*a* and 63*b* position the lead-out portions 12*a* and 12*b*.

A triangular bracket 64 which protrudes horizontally is provided to a bottom central portion of the first core-side resin member 6*a* and a screw hole 65 opposing the a screw hole 26 of the coil-side resin member 2*a* is provided to the tip of the bracket 64 (the apex of the triangle). The core-side resin member 6*a* and the coil-side resin member 2*a* are made into a single unit by tightening the screw holes 26 and 65 with a screw 7. Screw holes 66*a* and 66*b* for affixing the completed reactor to a case or an installation location are provided to both bottom ends of the first core-side resin member 6*a*.

A pin 62 is also provided to the top central portion of the second core-side resin member 6*b*, like in the first core-side resin member 6*a*, and the pin 62 is inserted into the recess 27 of the coil-side resin member 2*b* to performing positioning of the top of the core-side resin member 6*b* and the coil-side resin member 2*b*. A affixing piece 8 is affixed to the second core-side resin member 6*b* in an integrated manner through molding. A top part of the affixing piece 8 is gantry shaped and is embedded in the second core-side resin member 6*b*. Bottom ends of the affixing piece 8 project horizontally and have screw holes 81*a* and 8*b* for affixing the completed reactor to a case or installation location.

(4) Operation and Effects

With the edgewise coil of the present embodiment, a flat wire with a self-melting layer formed thereon is wound in an edgewise fashion and then adjacent segments of the flat wire are adhered to one another through heat and pressure. The coil can therefore be made into a single unit easily, with no need to provide separate molding resin or adhering resin. Furthermore, the gaps between the segments of the flat wire after winding are narrow, making impregnation with a resin or adhesive difficult, but with the present embodiment the self-melting layer is formed on surfaces of the flat wire ahead of time, so even if the gaps are narrow, there is plenty of melted resin, allowing solid joining of adjacent segments of the flat wire.

In particular, with the present embodiment, the coil-side resin members 2*a* and 2*b*, which are heat-resistant, are mounted on both ends of the coil unit 1 before applying pressure to the coil unit 1, preventing the force-applying jig, such as a mold, and the self-melting layer from coming in contact. This prevents contamination of the force-applying jig by the resin constituting the self-melting layer, difficulty in separation of the coil and the force-applying jig, and so on, which facilitates storage and management of the force-applying jig.

The coil-side resin members 2*a* and 2*b* of the present embodiment are provided with the recess 27 for positioning the core-side resin members 6*a* and 6*b* and the screw hole 26 for affixing them, instead of a simple member for preventing contact between the force-applying jig and the self-melting layer, so the edgewise coil acts also as a member used for affixing the core-side resin members 6*a* and 6*b*, obviating the need for a process to mount the coil-side resin members 2*a* and 2*b* to the coil unit 1 after self-melting of the coil unit 1 and making it possible to simplify the process of manufacturing the reactor. Note that the bracket 25 to which the screw hole 26 for affixing is provided acts as a affixing portion for affixing the core which is inserted into the coil unit 1. In other words, the bobbins 61*a* and 61*b* are placed inside the winding portions 11*a* and 11*b* with the block leg portions 4*a* and 4*b* inserted therein, and the coil-side resin members 2*a* and 2*b* and the core-side resin members 6*a* and 6*b* are affixed via the screw hole 26 for affixing, resulting in the core being affixed inside the core-side resin members 6*a* and 6*b*.

The end plate 21 and the edge plate 22 are provided to the coil-side resin members 2*a* and 2*b*, thereby protecting corners of the coil unit 1, which are easily damaged during handling, thereby providing the advantage of the edgewise coil not being susceptible to damage. By appropriate selecting the dimensions of the openings 23*a* and 23*b* provided to the end plate 21, the inner edges of the openings 23*a* and 23*b* can be used as guides when inserting the core-side resin members 6*a* and 6*b* into the coil unit 1, thereby making it possible to prevent the inner covering of the coil unit 1 from being damaged by the core-side resin members 6*a* and 6*b*.

2. Second Embodiment

A second embodiment of the present invention is described with reference to FIGS. 6 to 8. Parts which are the same as in the first embodiment are given the same reference numerals and description thereof is omitted.

Figure 6:
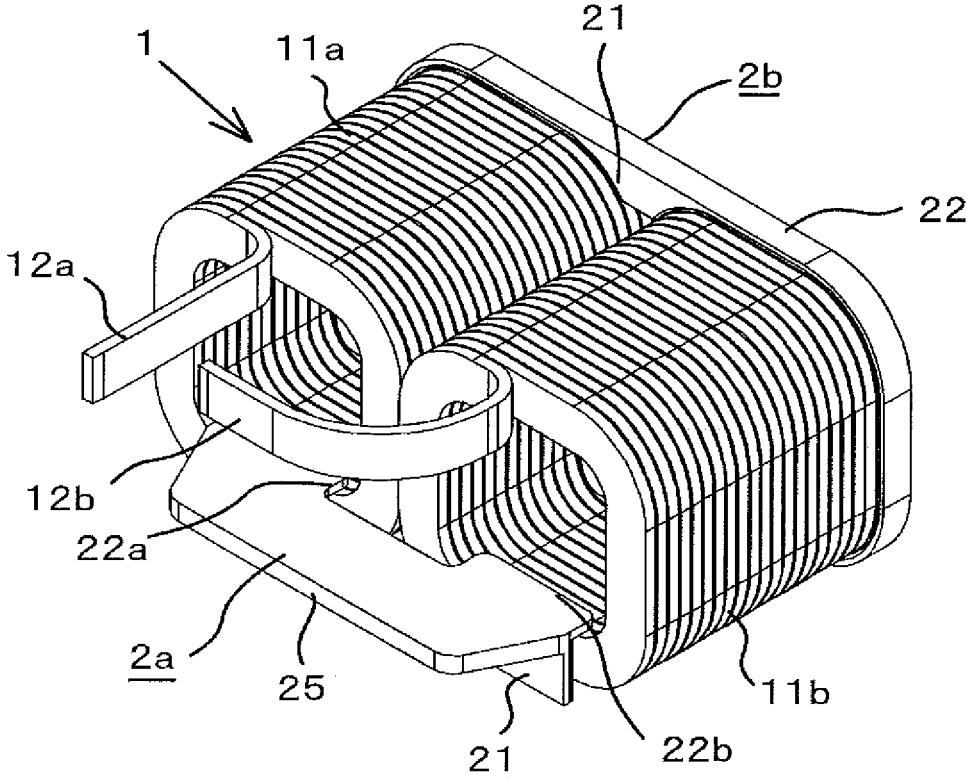
FIG. 6 is an oblique view of edgewise coil according to one or more embodiments of the present invention.
Figure 7:
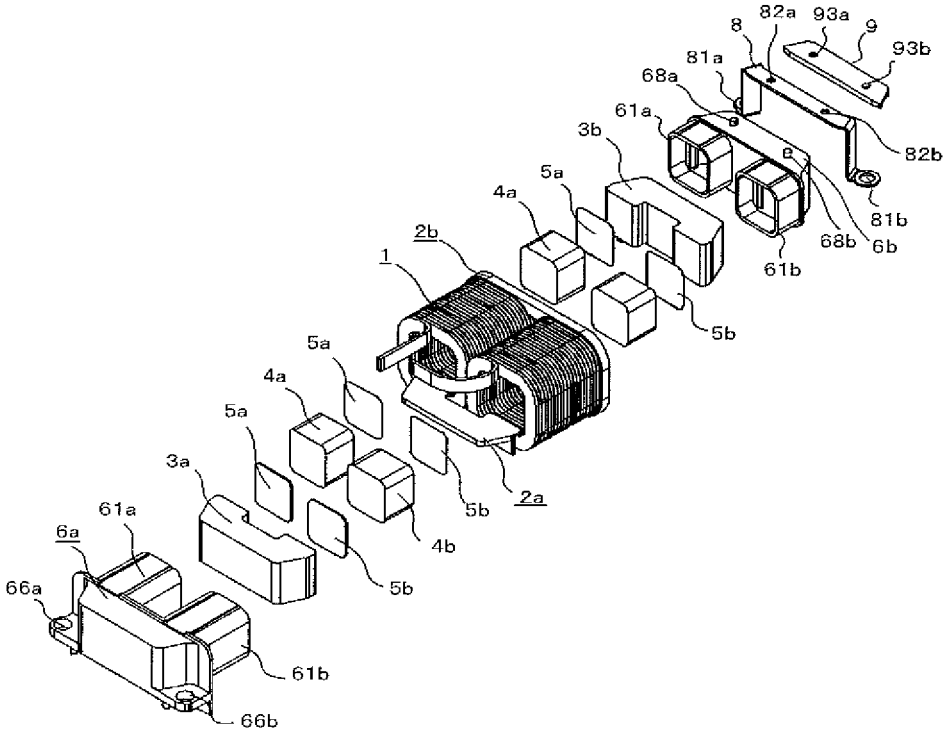
FIG. 7 is an exploded oblique view of a reactor incorporating the edgewise coil according to one or more embodiments of the present invention.

As shown in FIG. 6, in the present embodiment, the first coil-side resin member 2*a* is provided with the plate-shaped end plate 21 only to the bottom portion of the end faces of the left and right winding portions 11*a* and 11*b*. Edge places 22*a* and 22*b* which enter the left and right winding portions 11*a* and 11*b* are provided to the end plate 21. The bracket 25, which is platform-shaped and extends horizontally in the opposite direction as the edge places 22*a* and 22*b* but at the same height as the edge places 22*a* and 22*b*, is provided to the end plate 21. The bracket 25 is fitted into part of the core-side resin member 6*a* (bottom portion) when constituting the reactor, and is therefore shaped so as to cover the bottom face of the core.

When manufacturing the edgewise coil of the present embodiment, the force-applying jig is abutted against the end plate 21 of the first coil-side resin member 2*a* and the end plate 22 of the second coil-side resin member 2*b*, thereby applying pressure to the coil unit 1 in the axial direction thereof. As a result, like in the first embodiment, adjacent segments of the flat wire can be made into a single unit without letting the force-applying jig come into contact with the self-melting layer of the coil unit 1.

Figure 8:
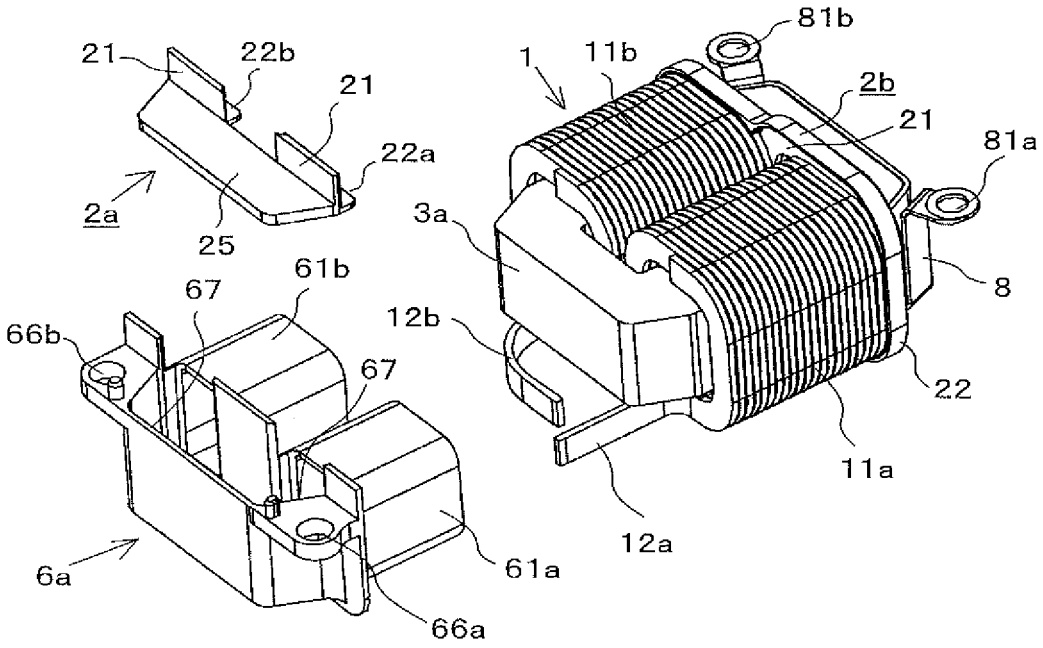
FIG. 8 is an exploded oblique view of the edgewise coil in FIG. 7 seen from the bottom.

As shown in FIG. 8, in a reactor using the edgewise coil of the present embodiment, a platform-shaped opening 67 is formed on the bottom of the first core-side resin member 6*a* and the platform-shaped bracket 25 provided to the first coil-side resin member 2*a* is fitted into the opening 67, thereby making the coil-side resin member 2*a* and the core-side resin member 6*a* into a single unit.

As shown in 7, in the second core-side resin member 6*b* of the reactor, the gantry-shaped affixing piece 8 is not a resin mold, and two pins 68*a* and 68*b* formed in the top face of the second core-side resin member 6*b* are engaged by being inserted into a pair of engaging holes 82*a* and 82*b* provided to the affixing piece 8. A resin cover 9 is affixed to the top face of the affixing piece 8 the pins 68*a* and 68*b* and engaging holes 93*a* and 93*b* provided to the cover 9.

With the present embodiment, the bracket 25 provided to the first coil-side resin member 2*a* is fitted into the opening 67 of the core-side resin member 6*a* to make the two into a single unit very simply, which is a simpler affixing operation than the one involving screws in the first embodiment. Moreover, the first coil-side resin member 2*a* can be smaller and form part of the second core-side resin member 6*a*, which has the advantage of using less resin in the reactor overall.

3. Third Embodiment

Figure 9A:
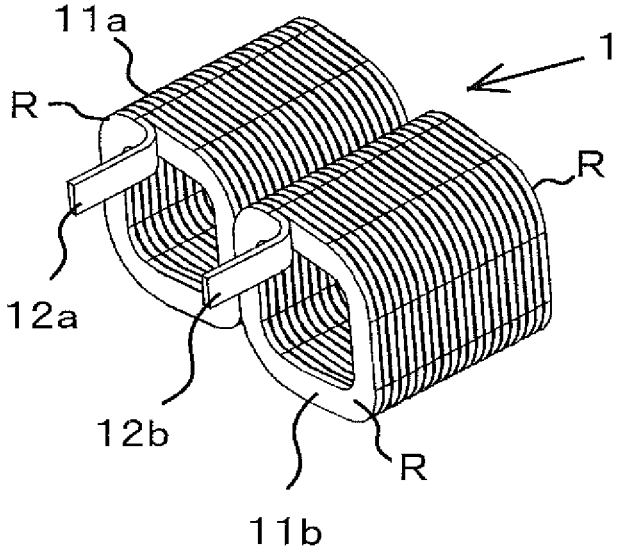
FIG. 9A is an oblique view of edgewise coil according to one or more embodiments of the present invention.
Figure 9B:
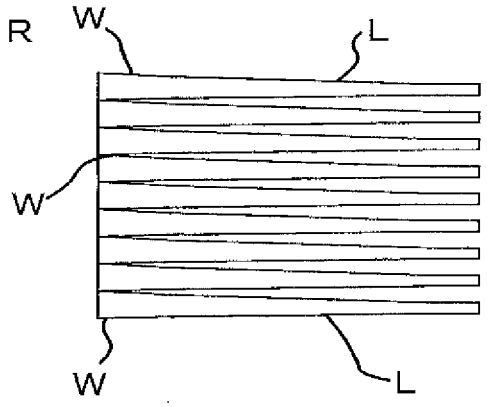
FIG. 9B is a cross-sectional view of a layered portion of flat wire constituting the edgewise coil according to one or more embodiments of the present invention.

A third embodiment is described with reference to FIGS. 9A and 9B. As disclosed in Japan Patent Application Publication No. 2009-261086 A, in the edgewise coil using conventional flat wire adjacent segments of the flat wire are tight against each other with no gaps therebetween, and therefore heat release from between the adjacent segments of the flat wire is difficult, which may cause heat becoming trapped inside the coil. In the present embodiment, as shown in the cross-sectional view in FIG. 9B, protrusions W which protrude from flat wire faces L on inner faces of bends Rat each of the four corners of the winding portions 11*a* and 11*b* are formed in the coil unit 1, and adjacent segments of the protrusions W are adhered to one another by the self-melting layer. Specifically, the protrusions W are adhered by the self-melting layer to the protrusions W in adjacent segments of the flat wire where the wound flat wire has adjacent segments. Therefore, adjacent segments of the flat wire are joined in points at the four corners of the inner circumference of the coil, with a gap formed between the surfaces of the adjacent flat wire segments which is about twice as high as the protrusions W (i.e., the protrusions are present at both ends, so about twice the height of the protrusions). The protrusions W are formed by a difference in the inner circumference and outer circumference arcs of the flat wire when the flat wire, having a fixed width, is wound in an edgewise manner. These protrusions are called winding wrinkles or fat areas and thin areas, etc. The protrusions W are formed being thicker on the inside of the flat wire than the outside, as shown in FIG. 9B, so in the present embodiment these protrusions W are used proactively.

With the present embodiment, the gaps are formed between adjacent segments of the flat wire, and when this is applied to a directly-cooled reactor, the refrigerant travels through the gaps between the flat wires, making is possible to achieve good heat-release performance. The coil unit 1 of the present embodiment can be used in combination with the coil-side resin members 2*a* and 2*b*, as in the first and second embodiment, but it is also possible to the coil unit 1 alone as the edgewise coil. In this case, it is possible to employ a means on the tip of the force-applying jig, such as a silicon resin cover or the like, which will not adhere to the self-melting layer.

4. Fourth Embodiment

Figure 10A:
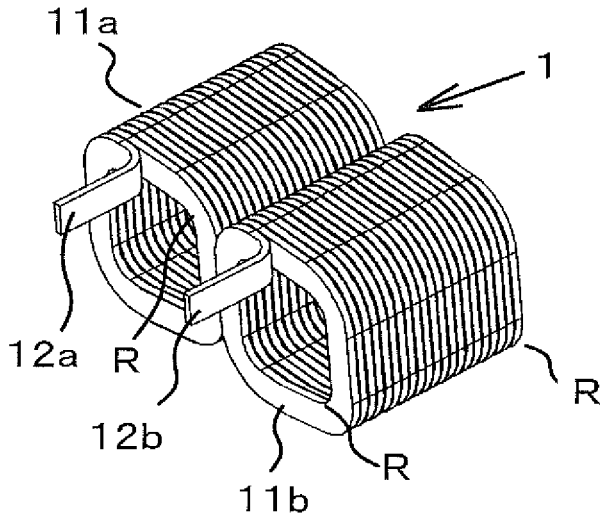
FIG. 10A is an oblique view of edgewise coil according to one or more embodiments of the present invention.
Figure 10B:
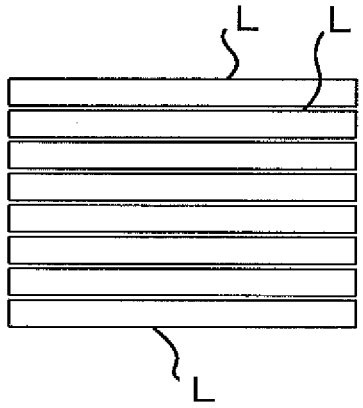
FIG. 10B is a cross-sectional view of a layered portion of flat wire constituting the edgewise coil according to one or more embodiments of the present invention.

A fourth embodiment is described with reference to FIGS. 10A and 10B. In the present embodiment, pressure is applied to the coil unit 1 in the axial direction of the coil after winding of the flat wire, which causes protrusions in the inner circumference of the bends R to be crushed, as shown in the cross-sectional view in FIG. 10B, making the surfaces of the flat wire flat. Adjacent segments of the flat wire are adhered to each other by the self-melting layer over their entire surface. The process of crushing the protruding portions may be done concurrently with the heating and pressurizing accompanying the self-melting, or crushing may be done alone, at room temperature, after the coils have been wound.

With the present embodiment, adjacent segments of the flat wire are adhered to one another over their entire surface, which makes it possible to achieve extremely high adhesion strength and to avoid the risk of foreign matter entering between coil layers. Furthermore there is the advantage of improved equivalent thermal conductivity in the direction of the winding axis. The coil unit 1 of the present embodiment can be used in combination with the coil-side resin members 2*a* and 2*b*, as in the first and second embodiment, but it is also possible to the coil unit 1 alone as the edgewise coil.

5. Fifth Embodiment (1) Constitution

Figure 11:
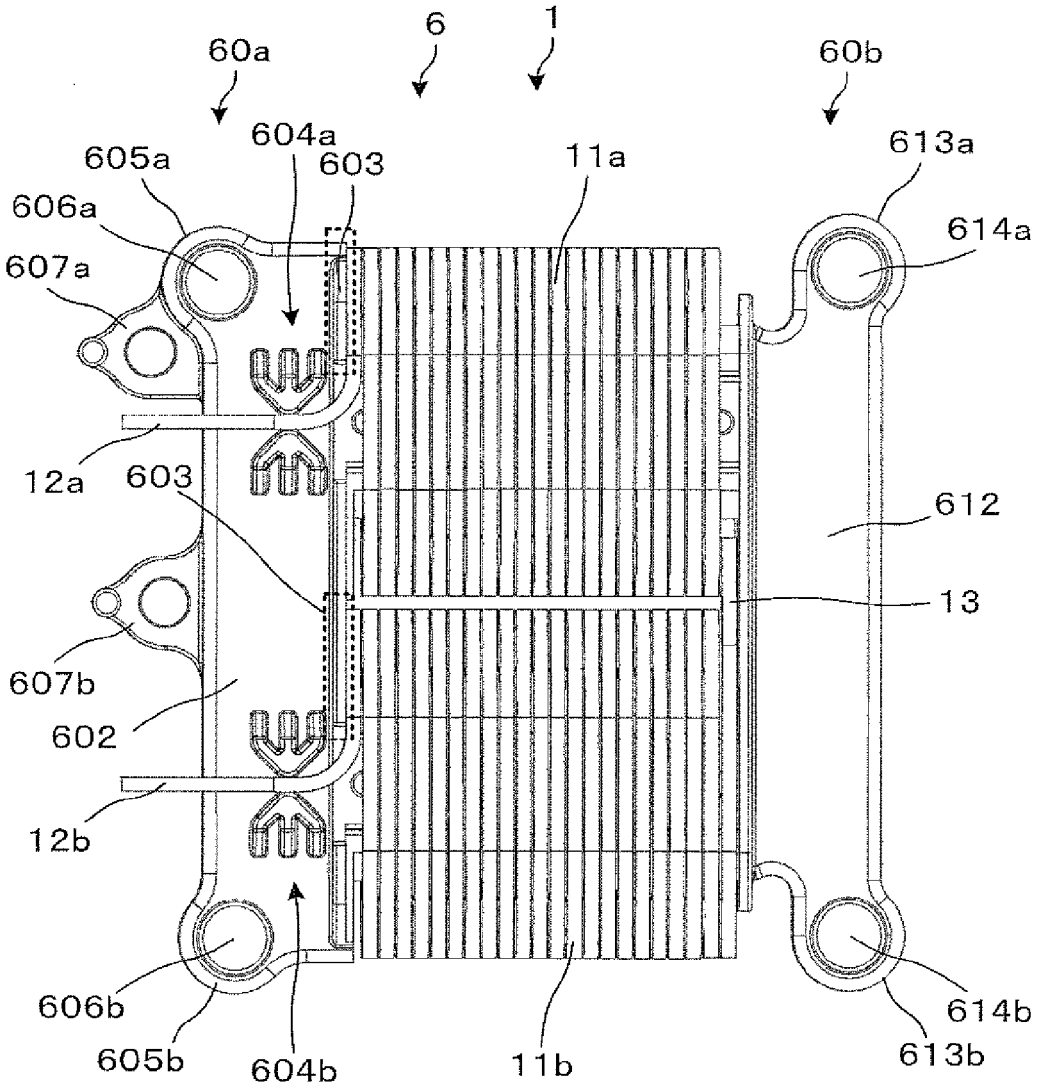
FIG. 11 is a plan view of a coil according to one or more embodiments of the present invention.
Figure 12:
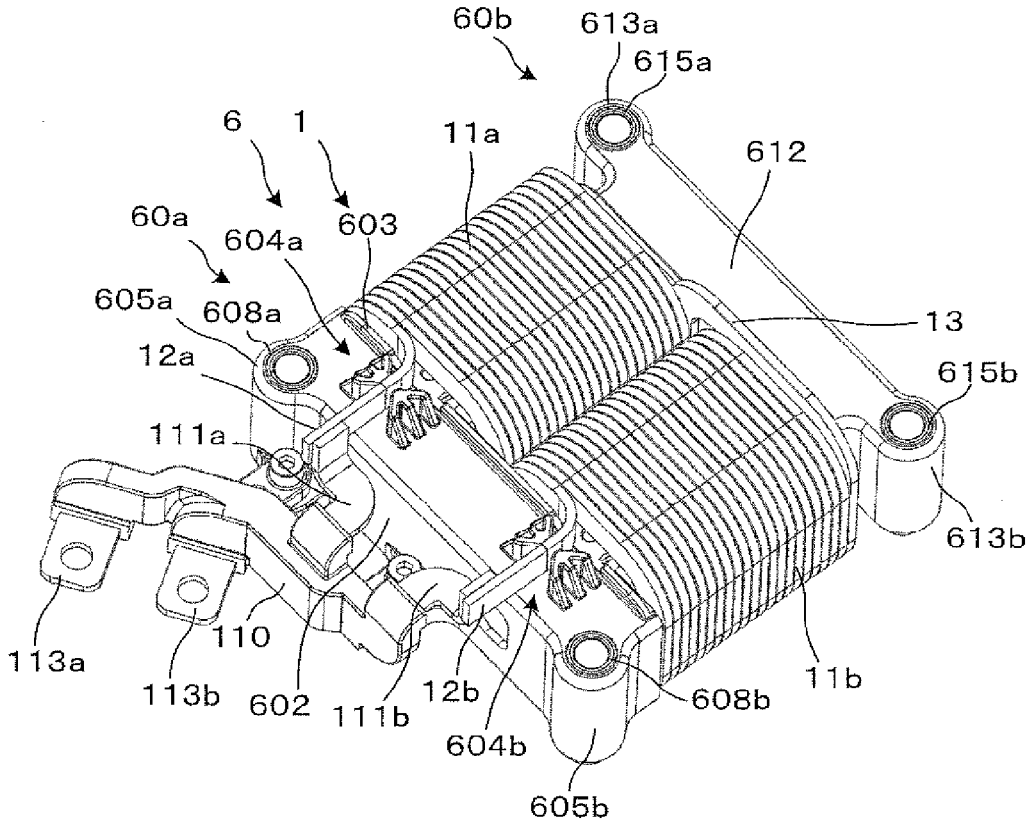
FIG. 12 is an oblique view of a reactor incorporating the coil according to one or more embodiments of the present invention.
Figure 13:
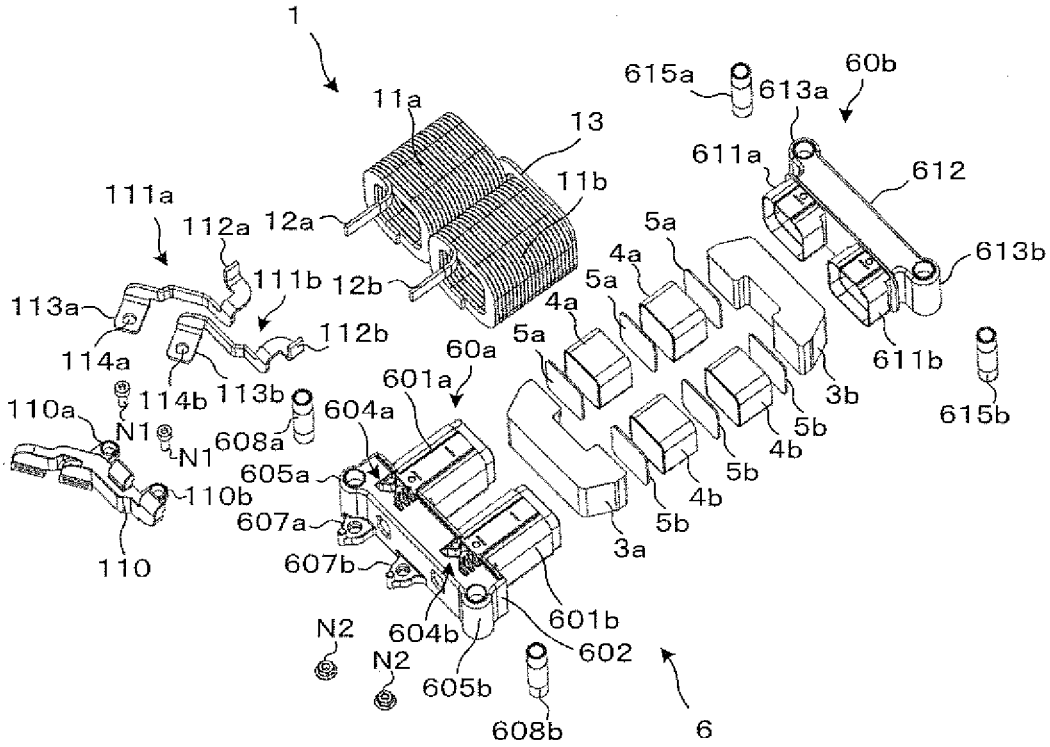
FIG. 13 is an exploded oblique view of a reactor incorporating the coil according to one or more embodiments of the present invention.

A coil according to a fifth embodiment and a reactor using this coil is described with reference to FIGS. 11 to 13. FIG. 11 is a plan view of a coil according to the present embodiment. FIG. 12 is an oblique view of a reactor according to the present embodiment. FIG. 13 is an exploded oblique view of the reactor according to the present embodiment. Parts which are the same as in the first embodiment are given the same reference numerals.

In the first embodiment, the coil-side resin members 2*a* and 2*b* were used as the resin members mounted on the coil unit 1, and a distinction was made between the coil-side resin members 2*a* and 2*b* and the core-side resin members 6*a* and 6*b*. However, in the fifth embodiment, a self-melting layer of the coil unit 1 is adhered directly to the resin members covering the core instead of providing the coil-side resin members 2*a* and 2*b*. A detailed description follows below.

As shown in FIGS. 11 to 13, the reactor is provided with an annular core, the coil unit 1, a resin member 6 which is mounted on the coil unit 1, a terminal block 110 attached to the resin member 6, and bus bars 111*a* and 111*b* provided to the terminal block 110.

The annular core, like in the first embodiment, is a magnetic body, such as a powdered magnetic core, a ferrite magnetic core, or laminated steel plates, etc., having an overall annular shape. The annular core has multiple split cores and is constituted by a pair of straight legs and a linking portion which connects ends of the legs. In the present embodiment, in the annular core, like in the first embodiment, the block leg portions 4*a* and 4*b*, which are the straight legs, and the first and second yoke portions 3*a* and 3*b* which form substantially a C-shape which is the linking portion are connected by adhesive or the link into a ring shape, with the spacers 5*a* and 5*b* interposed among the cores 3*a*, 3*b*, 4*a*, and 4*b*.

Like in the first embodiment, the coil unit 1 is provided with a wire and a self-melting layer formed on surfaces of the wire. The coil unit 1 is an edgewise coil in which the wire is flat wire. The self-melting layer comprises resin, as in the first embodiment. Resin ordinarily used in self-melting layers can be used as the resin constituting the self-melting layer, but a resin in which a melting film comprising a main epoxy agent and a curing agent is in a semi-cured state can be used. Note that the coil unit 1 is coil in which the wire is flat wire in the present embodiment, but because it is sufficient for adjacent segments of the wire to adhere to each other or to members other than the coil unit 1, the shape or winding manner of the wire is not a limitation in the present embodiment. For example, the wire may have a round, oval, or polygonal cross-section.

The structure of the winding portions 11*a* and 11*b*, the lead-out portions 12*a* and 12*b*, and the connection portion 13 of the coil unit 1 is the same as in the first embodiment.

The resin member 6 is adhered to the coil unit 1 and thereby affixed to the coil unit 1. Specifically, the self-melting layer of the coil unit 1 is adhered to the surface of the resin member 6, and the resin member 6 is affixed to the wire by the self-melting layer.

A which has adhesive properties with regard to the coil unit 1 and greater heat resistance than the adhesion temperature of the self-melting layer resin can be used for the resin member 6, like the resin members of the first embodiment.

The resin member 6 is formed so as to cover the outside of the annular core, and forms an overall ring-like shape, like the shape of the annular core. Accordingly, the resin member 6 is constituted by a pair of rectilinear portions and a linking portion connecting these. Specifically, as shown in FIG. 13, the resin member 6 is divided into two, with a substantially U-shaped first resin member 60*a* and a substantially C-shaped second resin member 60*b*, formed separately but with ends thereof abutting one another. The reason the first resin member 60*a* and the second resin member 60*b* are formed separately is in order to contain the block leg portions 4*a* and 4*b* and to fit the coil unit 1 thereonto.

The first resin member 60*a* is provided with a pair of cylindrical rectilinear portions 601*a* and 601*b*, a linking portion 602 connecting the rectilinear portions 601*a* and 601*b*, end portions 603 of the linking portion 602 that are in contact with end faces of the coil unit 1, positioning portions 604*a* and 604*b* provided to the linking portion 602, and affixing portions 605*a* and 605*b* which are provided to both ends of the linking portion 602. The second resin member 60*b* is provided with a pair of rectilinear portions 611*a* and 611*b*, a linking portion 612 which connects the rectilinear portions 611*a* and 611*b*, and affixing portions 613*a* and 613*b* which are provided to both ends of the linking portion 612.

U-shaped yoke portions 3*a* and 3*b* are embedded inside the linking portions 602 and 612. The rectilinear portions 601*a*, 601*b*, 611*a*, and 611*b* are called bobbins and the winding portions 11*a* and 11*b* are mounted on them. The block leg portions 4*a* and 4*b* are disposed in an alternating layering configuration with the spacers 5*a* and 5*b* inside the rectilinear portions 601*a*, 601*b*, 611*a*, and 611*b*. The spacers 5*a* and 5*b* are not necessarily needed. The winding portions 11*a* and 11*b* are mounted on the rectilinear portions 601*a*, 601*b*, 611*a*, and 611*b*.

The end portions 603 of the linking portion 602 are provided to the boundary between the linking portion 602 and the rectilinear portion 601*a*. In other words, the first resin member 60*a* forms a shape substantially like the Greek letter Pi (Π), and the end portions 603 are the faces where the rectilinear portions 601*a* and 601*b* meet the linking portion 602. The end faces of the coil unit 1 are adhered to the end faces 603. Specifically, the coil unit 1 is adhered to the first resin member 60*a* by means of the self-melting layer on the end face of the coil unit 1.

One method for causing the end faces of the coil unit 1 to adhere to the end faces 603 is, for example, to fit the rectilinear portions 601*a* and 601*b* into the hollow cores of the winding portions 11*a* and 11*b*, press the end faces of the coil unit 1 against the end faces 603 of the first resin member 60*a* in a heated atmosphere at 170 to 200° C. to cause the self-melting layer to melt, and then harden let this harden in this adhered state. When doing so, a force-applying jig may be used to apply pressure to the coil unit 1 as long as it does not become adhered to the self-melting layer, and therefore the second resin member 60*b* may be used as the force-applying jig to apply pressure to the coil unit 1. In other words, it is possible to apply pressure to the coil unit 1 with the second resin member 60*b*, causing the self-melting layer of one end of the coil unit 1 to become adhered to the end faces 603 of the first resin member 60*a*, and causing the self-melting layer at the other end of the coil unit 1 to become adhered to the linking portion 612 of the second resin member 60*b*.

The positioning portions 604*a* and 604*b* are provided to an outside surface of the linking portion 602 of the first resin member 60*a*. In the present embodiment, the positioning portions 604*a* and 604*b* have pair of protrusions which protrude out from the outside surface of the linking portion 602. These pairs of protrusions rise up substantially in an arrow shape from the linking portion 602 and are provided separated from another slightly less far apart than the thickness of the wire of the coil unit 1 such that ends thereof oppose one another. The lead-out portions 12*a* and 12*b* are inserted between these pairs of protrusions. Specifically, the self-melting layer of the lead-out portions 12*a* and 12*b* becomes adhered to the protrusions and the lead-out portions 12*a* and 12*b* are affixed in such a manner that they are positioned by the positioning portions 604*a* and 604*b*. The self-melting layer may be adhered to one or both of the protrusions.

As shown in 11, the protrusions are shaped like arrows spreading into three tines from a tip portion adhered to the self-melting layer of the lead-out portions 12*a* and 12*b*, and therefore outside force applied to the lead-out portions 12*a* and 12*b* is distributed to those three tines.

The affixing portions 605*a*, 605*b*, 613*a*, and 613*a* are used in order to affix the reactor to the case which is not shown in the drawings. The reactor is bolted to bolt insertion holes 606*a*, 606*b*, 614*a*, and 614*a* of the affixing portions 605*a*, 605*b*, 613*a*, and 613*a* via nuts 608*a*, 608*b*, 615*a*, and 615*b*.

The terminal block 110 supports the bus bars 111*a* and 111*b* connected to the lead-out portions 12*a* and 12*b* of the coil unit 1. The terminal block 110 is provided with attachment portions 110*a* and 110*b* for affixing to the first resin member 60*a*. Matching up the screw insertion holes and bearing portions 607*a* and 607*b* provided to the first resin member 60*a* affixes the terminal block 110 to the first resin member 60*a* by means of a screw N1 and a nut N2.

The bus bars 111*a* and 111*b* are embedded in the center of the terminal block 110 by resin molding. Ends 112*a* and 112*b* of the bus bars 111*a* and 111*b* rise up confronting the lead-out portions 12*a* and 12*b* and are welded to wire where the self-melting layer of the lead-out portions 12*a* and 12*b* is peeled and exposed. Screw insertion holes 114*a* and 114*b* are provided to plates 113*a* and 113*b* at other ends, and by screwing these in, a connection to wiring of an external device, such as an external power supply, is established. When power is supplied from an external power supply, a magnetic flux is produced which passes through the winding portions 11*a* and 11*b* due to a current flowing through the coil unit 1, thereby forming a magnetic circuit closed in a ring inside the annular core.

(2) Operation and Effects

With the present embodiment, the coil is provided with a coil unit 1 which is provided with a wire, a self-melting layer formed on surfaces of the wire, and a resin member 6 which is affixed to the wire, wherein the wire is affixed by adhering to the resin member 6 by the self-melting layer. Manufacturing reactors and other electronic parts can be done easily by combining a core or the like to the coil unit 1.

In conventional art, in general the self-melting layer at the tip of a coil used in a reactor is peeled, exposing the wire, and this exposed wire tip is welded and affixing to a bus bar for connecting to an external device, but when the reactor is being used, external force due to vibration of the external device or the reactor itself is applied to the welded portion between the coil tip and the bus bar, creating the risk that the connection between the coil tip and the bus bar will be physically lost.

The reactor of the present embodiment, on the other hand, may be a reactor provided with a core, a coil unit 1, and a resin member 6 affixed to the wire of the coil unit 1, wherein the core is embedded inside a first resin member 60*a*, positioning portions 604*a* and 604*b* for positioning lead-out portions 12*a* and 12*b*, which are tips of the coil unit 1 are provided to surfaces of the first resin member 60*a* into which the core is embedded, a self-melting layer of the lead-out portions 12*a* and 12*b*, which are tips of the wire, adheres to the positioning portions 604*a* and 604*b*, and the coil unit 1 is thus affixed to the first resin member 60*a*. In particular, the positioning portions 604*a* and 604*b* are a pair of protrusions which protrude from the surface of the first resin member 60*a*, and the tip of the wire of the coil unit 1 is sandwiched between the pair of protrusions, causing the self-melting layer to adhere to the protrusions.

The lead-out portions 12*a* and 12*b* are thus affixed to the first resin member 60*a* by the positioning portions 604*a* and 604*b*, and therefore it is difficult for external forces such a vibration of the reactor or other external devices to be applied to where the lead-out portions 12*a* and 12*b* and ends 112*a* and 112*b* of bus bars 111*a* and 111*b* connect, making it possible to obtain a reactor with enhanced durability. In other words, not only is one protrusion sandwiched, but rather the self-melting layer of the coil unit 1 is also adhered to the protrusions, making the lead-out portions 12*a* and 12*b* even more strongly affixed, making it possible to minimize stress caused by vibration in the reactor, etc., from communicating to the weld with the bus bars 111*a* and 111*b*.

The adhesion of the of the self-melting layer of the lead-out portions 12*a* and 12*b* is particularly effective when the coil unit 1 is not affixed to a case containing the reactor. Specifically, if the coil unit 1 is not affixed to the case, there is a gap between the bottom of the reactor and the case, and the coil unit 1 vibrates during use of the reactor, which applies stress to where the lead-out portions 12*a* and 12*b*, at the tip of the wire, is welded to the bus bars 111*a* and 111*b*, reducing durability, but because the lead-out portions 12*a* and 12*b* are affixed to the first resin member 60*a*, so the stress applied to the welded part can be reduced and durability can be enhanced.

Furthermore, an end face of the coil unit 1 is adhered to the first resin member 60 by the self-melting layer on that end face. The coil unit 1 can also be affixed to the first resin member 60*a* thereby. Communication of stress due to vibration or the like from the coil unit 1 to the welded portion of the bus bars 111*a* and 111*b* can thus be minimized. Moreover, because the end face of the coil unit 1 is directly adhered to the first resin member 60, the self-melting layer can be prevented from adhering to the pressure mold, obviating the need to mount the coil unit 1 onto the first resin member 60 separately, improving production.

6. Sixth Embodiment

Figure 14A:
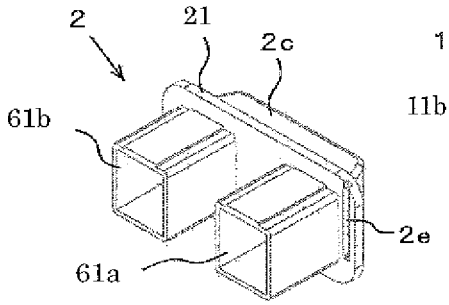
FIG. 14A is an oblique view of a shape of a resin member of the coil according to one or more embodiments of the present invention.

A sixth embodiment of the present invention is described in detail below, with reference to FIGS. 14A to 14C.

(1) Constitution

A coil according to the present embodiment comprises a coil unit 1, a resin member 2 combined therewith, and a temperature sensor 3 (hereafter "sensor") affixed to the surface of the coil unit 1.

The coil unit 1 of the present embodiment has two winding portions 11*a* and 11*b* for mounting on left and right legs of a reactor having an annular core. The two winding portions 11*a* and 11*b* are connected via a connection portion 13 formed at one end thereof.

For the coil unit 1, a coil on which is formed a self-melting layer of a heat-curing resin in a semi-cured state on surfaces of the wire (also called self-melting coil), like the coils described above.

While there is no particular limitation on what kind of wire to use, an edgewise coil made out of flat wire is used here, as in the previous embodiments.

Compared to conventional art, in which flat wire is wound into a coil and made into a single unit by impregnating it in or molding it with resin, this type of self-melting edgewise coil uses flat wire which has a self-melting layer, making it possible to eliminate the complexity of the steps involved in impregnation, and the risk of damaging the covering of the wire during molding.

The resin member 2 has a covering 2*c* in which is embedded a yoke portion of the annular core, and left and right bobbins 61*a* and 61*b* formed as a pair with the covering 2*c*. The left and right bobbins 61*a* and 61*b* are cylindrical and block-shaped cores constituting the legs of the annular core are inserted thereinto. The resin member 2 is combined in a ring with a second resin member which is not shown in the drawings similarly having a yoke and left and right legs, and winding portions 11*a* and 11 *b* of the coil unit 1 are mounted around the bobbins 61*a* and 61*b*, thus constituting the reactor.

An end plate 21 is formed so as to cover the entirety of the end faces of the winding portions 11*a* and 11*b* on a portion of the resin member 2 opposing the end faces of the winding portions 11*a* and 11*b*. In other words, the end plate 21 is formed as a flange at the bases of the bobbins 61*a* and 61*b*. A groove-like recess 2*e* into which the sensor 3 is mounted is formed to a portion of the end plate 21 opposing the coil end faces. In the present embodiment, the recess 2*e* is provided in a vertical direction (at a right angle to the direction in which the two winding portions 11*a* and 11*b* are disposed) on the outside of the bobbin 61*a*.

The resin member 2 comprises a material which has greater heat resistance than the adhesion temperature of the self-melting layer, such as PPS (polyphenylsulfide) resin, for example.

The sensor 3 of the present embodiment is a straight rod having appropriate dimensions and shape for being contained in the recess 2*e*, and is provided at one end with a lead line 13*a* for output the sensor signal.

(2) Manufacturing Method

The coil of the present embodiment is manufactured as follows.

Figure 14B:
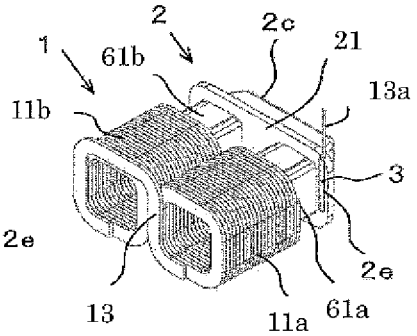
FIG. 14B is an oblique view of the coil and the resin member being combined according to one or more embodiments of the present invention.
Figure 14C:
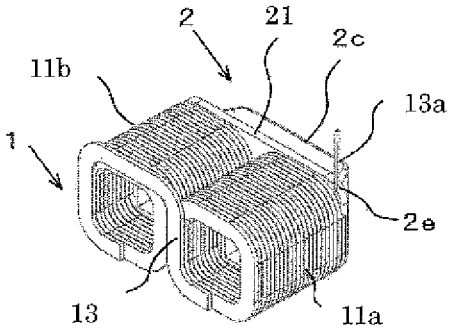
FIG. 14C is an oblique view showing a completed state of the coil according to one or more embodiments of the present invention.

First, the coil unit 1 is formed, having the left and right winding portions 11*a* and 11*b* and the connection portion 13 as shown in FIGS. 14B and 14C by winding flat wire with a self-melting layer formed on surfaces thereof in an edgewise manner. Winding of the flat wire is done at room temperature, so that the self-melting layer on the surface does not melt, causing adjacent segments of the flat wire to adhere to one another.

After the coil unit 1 is formed, the coil unit 1 and the resin member 2 are combined so as to insert the bobbins 61*a* and 61*b* into the winding portions 11*a* and 11*b*. When doing so, as shown in FIGS. 14B and 14C, the sensor 3 is disposed inside the recess 2*e*, and with the end face of the winding portions 11*a* and 11*b* abutting the end plate 21, axial-direction pressure is applied to the coil unit 1 and the resin member 2 in a heated atmosphere at 170 to 200° C. The mold or other force-applying jig is caused to abut the resin member 2 in this case, thereby preventing the force-applying jig from coming in contact with the coil unit 1.

When pressure is applied to the coil unit 1 in a heated atmosphere, the resin constituting the self-melting layer melts, which causes adjacent segments of the flat wire to adhere to one another by means of the melted resin, turning the entire coil into a single unit. At the same time, the self-melting layer of the coil unit 1 melts, causing the sensor 3, which is mounted in the groove 2*e*, to adhere to the end face of the coil unit 1, with the result that the sensor 3 is affixed to the coil unit 1 as shown in FIGS. 14B and 14C.

Note that, while not shown in the drawings, the second resin member mounted opposite the coil unit 1 is also combined with the coil unit 1 at the same time, and heat and pressure are applied thereto to achieve a single unit. Of course, the application of heat and pressure to the second resin member may be done separately from that of the first resin member 2 and the coil unit 1 shown in the drawings.

The resin member 2 in the present embodiment is constituted by PPS resin, which has a melting point of around 280° C., and therefore has good heat resistance and is not affected by the melting temperature of the self-melting layer. Therefore, the force-applying jig which comes in contact with the resin member 2 can easily separate from the surface of the resin member 2 after pressure has been applied, despite having melted the self-melting layer of the coil unit 1. On the other hand, because the coil unit 1, the resin member 2, and the sensor 3 have been adhered to one another by the self-melting layer of the coil unit 1, post-pressure handling is easy.

(3) Operation and Effects

With the present embodiment, the flat wire can be made into a single unit and the sensor 3 can be attached to the coil unit 1 concurrently, making the manufacturing process for the coil extremely easy. Moreover, because no filler or adhesive is used, the advantage is provided of being able to affix the sensor 3 to the surface of the coil unit 1 without fail, which means this can be applied to a reactor which does not use filler. The coil unit 1 and the resin member 2 are heated and subjected to pressure after the sensor is mounted in the groove 2*e*, so no unnecessary load is applied to the sensor inside the recess 2*e* during application of pressure, eliminating the risk of damage to the sensor 3.

7. Seventh Embodiment

Figure 15A:
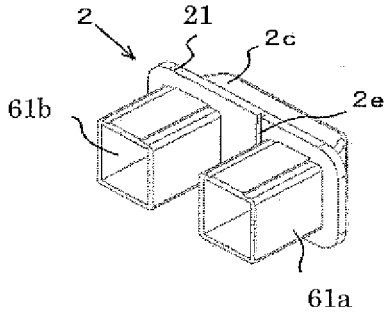
FIG. 15A is an oblique view of a shape of a resin member of the coil according to one or more embodiments of the present invention.
Figure 15B:
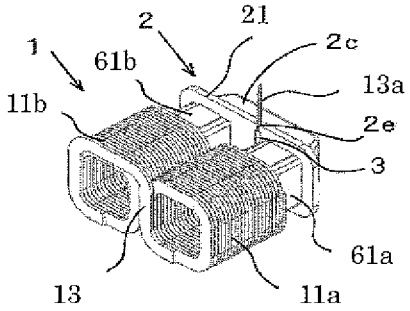
FIG. 15B is an oblique view of the coil and the resin member being combined according to one or embodiments of the present invention.
Figure 15C:
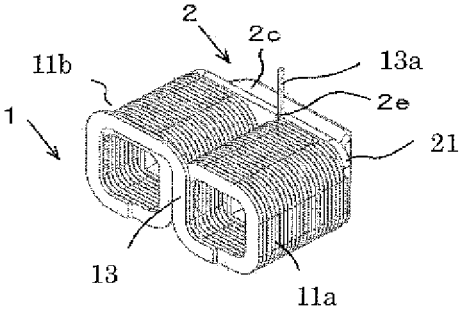
FIG. 15C is an oblique view showing a completed state of the coil according to one or embodiments of the present invention.

A seventh embodiment of the present invention is described in detail below, with reference to FIGS. 15A to 15C. In the present embodiment, the recess 2*e* is provided in a vertical direction (at a right angle to the direction in which the two winding portions 11*a* and 11*b* are disposed) between the left and right bobbins 61*a* and 61*b*. The rest of the constitution is the same as in the sixth embodiment.

With the present embodiment, in addition to the operation and effects of the sixth embodiment, the sensor 3 is disposed between the two winding portions 11*a* and 11*b*, allowing more accurate detection of temperature inside the coil unit 1.

8. Eighth Embodiment

Figure 16A:
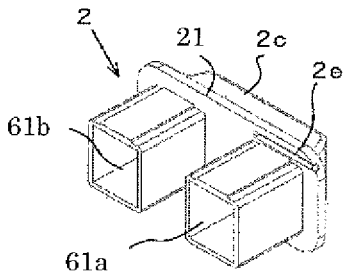
FIG. 16A is an oblique view of a shape of a resin member of the coil according to one or more embodiments of the present invention.
Figure 16B:
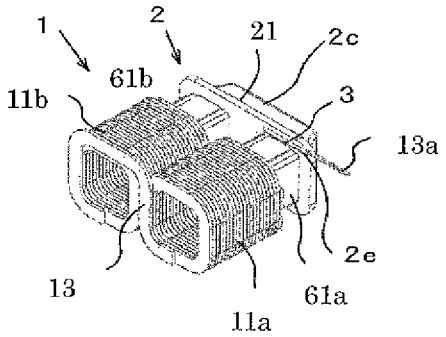
FIG. 16B is an oblique view of the coil and the resin member being combined according to one or more embodiments of the present invention.
Figure 16C:
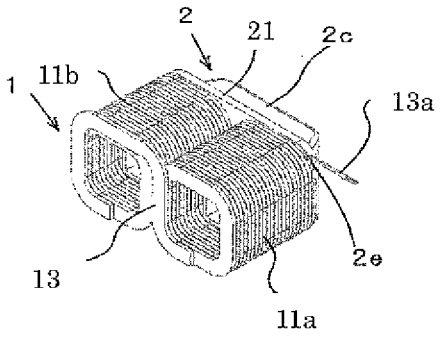
FIG. 16C is an oblique view showing a completed state of the coil according to one or more embodiments of the present invention.

An eighth embodiment of the present invention is described in detail below, with reference to FIGS. 16A to 16C. In the present embodiment, the recess 2*e* is provided in a horizontal direction (in the direction in which the two winding portions 11*a* and 11*b* are disposed) above the left and right bobbins 61*a* and 61*b*. The rest of the constitution is the same as in the sixth embodiment.

In addition to the operation and effects of the sixth embodiment, the present embodiment can be used when there are limitations to where the sensor 3 can be disposed, unavailable with the sixth and seventh embodiments. Moreover, because the recess 2*e* is horizontal to the direction the two winding portions 11*a* and 11*b* are disposed in, it can be made longer, which is suitable for a long sensor.

9. Ninth Embodiment

Figure 17A:
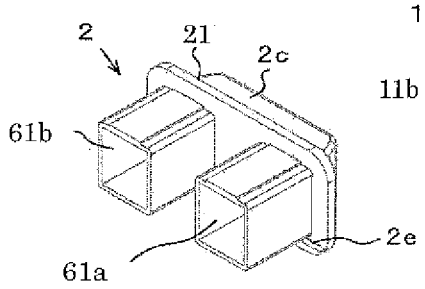
FIG. 17A is an oblique view of a shape of a resin member of the coil according to one or more embodiments of the present invention.
Figure 17B:
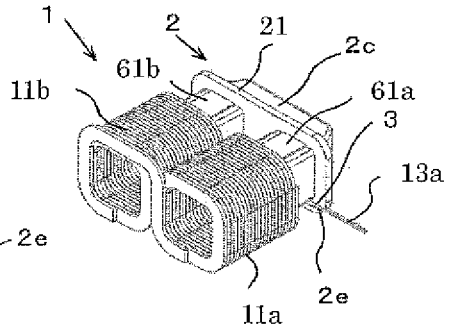
FIG. 17B is an oblique view of the coil and the resin member being combined according to one or more embodiments of the present invention.
Figure 17C:
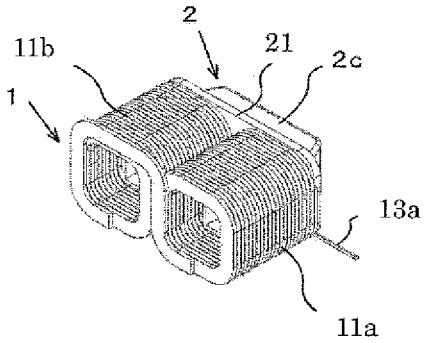
FIG. 17C is an oblique view showing a completed state of the coil according to one or more embodiments of the present invention.

A ninth embodiment of the present invention is described in detail below, with reference to FIGS. 17A to 17C. In the present embodiment, the position of the recess 2*e* of the eighth embodiment is moved to the bottom of the coil. Specifically, in the present embodiment, the recess 2*e* is provided in a horizontal direction (in the direction in which the two winding portions 11*a* and 11*b* are disposed) below the left and right bobbins 61*a* and 61*b*. The rest of the constitution is the same as in the eighth embodiment.

In addition to the operations and effects of the eighth embodiment, the present embodiment has the advantage that temperature detection at the bottom of the coil, where heat tends to accumulate, is easy.

10. Tenth Embodiment

Figure 18A:
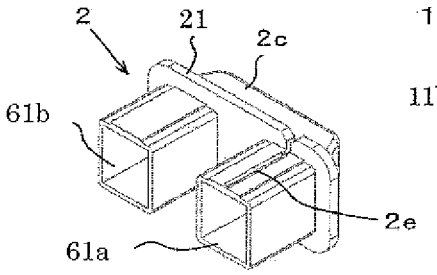
FIG. 18A is an oblique view of a shape of a resin member of the coil according to one or more embodiments of the present invention.
Figure 18B:
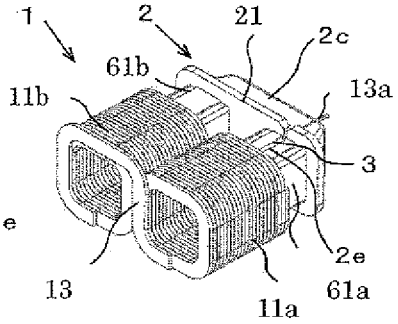
FIG. 18B is an oblique view of the coil and the resin member being combined according to one or more embodiments of the present invention.
Figure 18C:
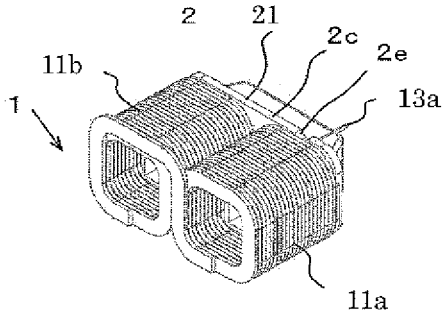
FIG. 18C is an oblique view showing a completed state of the coil according to one or more embodiments of the present invention.

A tenth embodiment of the present invention is described in detail below, with reference to FIGS. 18A to 18C. The present embodiment moves the position of the recess 2*e* to the surface of the bobbin 61*a*. Specifically, with the present embodiment, the recess 2*e* is provided along the axial direction of the winding portion 1*a* on an upper surface of the bobbin 61*a*. The rest of the constitution is the same as in the sixth embodiment.

With the present embodiment, in addition to the operation and effects of the sixth embodiment, the sensor 3 can be in contact with the entire surface of the coil, and therefore has the advantage of improving temperature detection precision. Temperature detection on the inside of the coil, which was impossible with the previous embodiments, is possible.

11. Other Embodiments

The present invention is not limited to the above embodiments, and also includes, for example, at least the following embodiments.

(1) In the embodiments shown in the drawings, one resin member was mounted to left and right both ends of the coil body, but the number of coil units onto which the resin members are mounted can be one or three or more according to the type of electronic part being made with the edgewise coil.

(2) The flat wire used in one or more embodiments of the present invention is not limited to wire having a tetragonal cross-sectional shape. Flat wire which has rounded or tapered/chamfered corners can naturally be used, as can flat wire whose inner or outer circumference has protrusions. For example, if flat wire having ridges along its inner circumference is used, the area of heat release through gaps between adjacent segments of the flat wire can be increased and greater adhesive power can be achieved. On the other hand, if a ridge is formed along the outer circumference, it is possible to lower the risk of foreign matter entering between adjacent segments of the flat wire.

(3) In the embodiments shown in the drawings, the coil unit is constituted by winding the flat wire in a tetragonal configuration, meaning there are four bends in the square shape and the protrusions protruding from the surface of the flat wire are formed substantially as points at each of the four corners. If the coil unit is constituted as a circular winding, the protrusion is formed along the entire inner circumference of the coil, so the area of heat release through gaps between adjacent segments of the flat wire can be increased and greater adhesive power can be achieved, like in the case when the protrusion is formed along the entire inner circumference of the cross-section of the flat wire in (2) above.

(4) The "adhesion" according to one or more embodiments of the present invention is not limited to covering the ends of the coil unit as shown in the drawings. Any configuration or structure capable of affixing or engaging the ends of the coil unit without coming off during application of pressure. For example, it is possible to use tape or the like to provisionally hold a plate-like resin member against the portion which the pressure-applying member, e.g., a mold, abuts, apply the heat and pressure, and then affix the coil unit and resin member using the self-melting layer of the flat wire.

(5) In a case where the coil unit is adhered by means of the self-melting layer to adjacent segments of the flat wire by protrusions from the flat wire along the inner circumference of bends therein, the melting adhesion may be done along the entire inner circumference or it may be done with adjacent segments of flat wire only in certain places, such as the four corners of the flat wire if it is wound in a square. Furthermore, if flat wire is used which has a cross-sectional shape in which the outside of the coil protrudes, it is possible to adhere the coil along the entire outer circumference thereof or just in places, with adjacent segments of the flat wire.

(6) It is also possible to melt and adhere adjacent segments of flat wire if protrusions are formed on the surface of the flat wire and some of those protrusions are crushed and disappear until the surface of the flat wire becomes flat. It is also possible to melt together all or some of the segments of the flat wire which have flat surfaces with no protrusions.

(7) It is possible to provide the positioning portions 604*a* and 604*b* to the first resin member 60*a* or to the linking portion 612 of the second resin member 60*b*. If the lead-out portions of the coil unit 1 extend out from the linking portion 602 and the linking portion 612, it is also possible to provide the positioning portions to both the linking portion 602 and the linking portion 612, associated respectively.

(8) It is possible to adhere the self-melting layer of the coil unit 1 to only the end portion 603 of the linking portion 602, which is one end face of the two end faces of the coil unit 1, and it is also possible to adhere the self-melting layer of the coil unit 1 to the end face of the other linking portion 612 by pressing the other linking portion 612 against the coil unit 1 in the axial direction of the winding.

(9) The protruding tips of the positioning portions 604*a* and 604*b* which oppose one another may be formed as sharp points or flat. The area of adhesion of the self-melting layer thereby grows, allowing more solid affixing, and therefore a greater reduction in the stress on the bus bars 111*a* and 111*b*.

(10) The positioning portions 604*a* and 604*b* may be constituted as a pair of protrusions protruding from the outer face of the linking portion 602, or it is also possible to form a groove-like recess in part of the surface of the resin member 6, fit the lead-out portions 12*a* and 12*b* into this part, and melt the self-melting layer of the lead-out portions 12*a* and 12*b*. Furthermore, it is also possible to raise up projections having openings from the outer surface, pass the lead-out portions 12*a* and 12*b* through these holes, and melt the self-melting layer for adhesion.

(11) In the above embodiments, it is also possible to adhere the self-melting layer along the inner circumference of the winding portions 11*a* and 11*b* of the coil unit 1 to the surface of the resin member 6. This coil unit 1 can thus be more strongly affixed by the resin member 6.

(12) In the above embodiments, it is possible to provide a protective cover made of a resin such as PPS to protect the reactor from foreign matter such as metal dust. In this case, it is possible for the coil unit 1 to be pressed down by the protective cover and the bottom face of the protective cover to be adhered to the self-melting layer of the coil unit 1. Furthermore it is also possible to press down on the self-melting layer of the lead-out portions 12*a* and 12*b* by the protective cover and thereby adhere and affix the protective cover and the coil unit 1 to one another.

(13) It is also possible, if the reactor is placed inside a case and the coil unit 1 is not affixed by filler, to adhere and affix spacers to the bottom of the coil unit 1 with the self-melting layer. Specifically, the spacers are resin members made out of PPS or the like and have a height equal to the distance separating the bottom of the coil unit 1 from the bottom of the case, and are adhered by the self-melting layer on the bottom of the coil unit 1. If the reactor is bolted to the case, the spacers are sandwiched between the bottom of the coil unit 1 and bottom of the case, making it possible to position and affix the coil unit 1.

(14) In the above embodiments, it is also possible to adhere the self-melting layer of the coil unit 1 to the resin member used in the reactor. Namely, it is possible to adhere the self-melting layer of the coil unit 1 to a resin member other than the resin member used in the reactor. For example, if the resin member is provided to where the reactor is mounted, it is also possible to affix the reactor by adhering the self-melting layer of the coil unit 1 to this resin member. An example of where the reactor might be mounted is a circuit board, and the self-melting layer of the coil unit 1 is adhered to the resin substrate or a resin member on the circuit board. Furthermore, it is also possible to adhere the self-melting layer of the coil unit to a non-conductive mounting surface. Note that if the resin member or installation surface onto which the self-melting layer of the coil unit 1 is adhered is rough, the adhesion is stronger. It is also possible to sand-blast or apply wrinkles to the resin member or the installation surface in order to improve the adhesion of the resin member or installation surface adhered using the self-melting layer. It is also possible to perform plasma treatments, corona treatments, and UV treatments to cause the surface to oxidize with ozone. If the resin of the self-melting layer is an epoxy resin, PPS made by DIC (product name: FZ-840-D1) can be used since it has good adhesion with epoxy resins.

(15) The coil unit 1 may be a single coil with one winding instead of a pair of coils. Furthermore, the direction of the axial direction of the windings in the coil unit 1 need not be parallel to the installation surface, but may also be vertical, and the self-melting layer of the connection portion 13 may also be adhered to the installation surface instead. There is no limitation on the location of the self-melting layer of the coil unit 1 which is adhered to the installation surface.

(16) It is also possible for the resin forming the self-melting layer to be a single-liquid or three-liquid epoxy resin, and not just a two-liquid epoxy resin comprising a main ingredient and a curing agent. Aside from an epoxy resin, resins such a phenol resins, acrylic resins, polyimide resins, and resins in which part of an epoxy resin is denatured into a phenol resin can be used. Furthermore, the resin in the resin member can be a thermoplastic resin or a heat curing resin. Aside from PPS resins, examples of thermoplastic resins which can be used include ABS resins, AS resins, polyamide, polybutylene terephthalate, polycarbonate, polyethylene, polyethylene terephthalate, acrylic, polyacetal, polypropylene, polystyrene, and so on.

(17) The following resins can be used for the resin member. Examples include epoxy resins, unsaturated polyester resins, urethane resins, BMC (bulk molding compound), PBT (polybutylene terephthalate), and so on.

(18) Aside from two coils disposed parallel to one another, it is also possible to use any number of coils of other shapes. For example, it is possible to apply the present invention to a reactor having one straight coil, a coil formed in an overall ring shape, two or more coils having an annular core and one leg, and so on.

(19) There is no limitation in the end portion of the coil for mounting an electronic part such as the sensor 3, for example. It is also possible to form a bracket protruding towards the space between two coils as a single unit with two coil bobbins provided to the resin member, provide a recess on the coil surface of the bracket, and mount the electronic part in that recess. This case has the advantage of being able to measure the temperature between two coils, a space which can get extremely hot.

(20) The electronic part, such as the sensor 3, for example, is not limited to the thermistor of the drawings. Not only are other types of temperature sensors included in the electronic part of the present invention, but also acceleration sensors which detect vibration applied to the coil, sensors which measure electric or magnetic fields around the coil, angular velocity sensors, wiring connectors, a name plate for the coil or reactor, and so on.

Figure 19A:
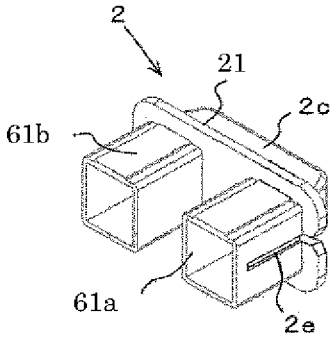
FIG. 19A is an oblique view of a shape of a resin member of the coil according to one or more embodiments of the present invention.

(21) The shape of the electronic part is also not limited to straight, as shown in the drawings, but can appropriately include block shapes, plate shapes, ring shapes, and so on, and the recess where the electronic part is mounted can also be varied appropriately to match its shape. For example, it is also possible to provide the recess to the outside of the coil bobbin as shown in FIG. 19A.

(22) The shape of the resin member is also not limited to that shown in the drawings. For example, it is also possible to use a resin member which does not have a part covering the core or coil bobbins, and therefore does not have the core embedded or mounted therein. For example, it is also possible to use a resin member which is disposed outside the main body of a cylindrical coil. It is also possible to make the cover protecting the electronic part out of a resin member and adhere the protective cover and the electronic part inside together to the self-melting layer of the coil.

Figure 19B:
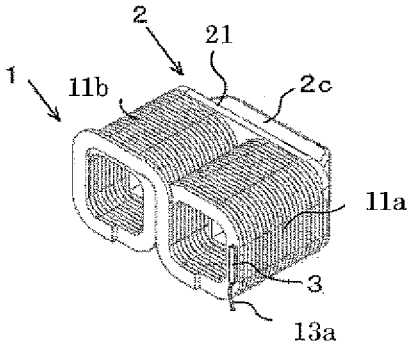
FIG. 19B is an oblique view showing an electronic part affixed to a surface of flat wire in a coil according to one or more embodiments of the present invention.
Figure 19C:
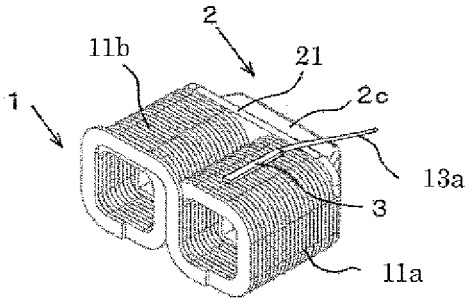
FIG. 19C is an oblique view showing an electronic part affixed to an outer circumferential face of a coil according to one or more embodiments of the present invention.
Figure 19D:
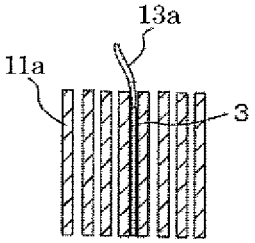
FIG. 19D is an oblique view showing an electronic part affixed between adjacent segments of flat wire in a coil according to one or more embodiments of the present invention.

(23) As shown in FIGS. 19B and 19C, it is also possible to affix the electronic part to the outer circumference of the coil or to the surface of the flat wire of the coil end, in which case the self-melting layer on the surface of the winding is used to adhere the electronic part directly, without using the resin member. This is particularly suited to a thin, flat electronic part. Moreover, it is also possible to insert the electronic part between adjacent segments of the flat wire constituting the coil as shown in FIG. 19D, affixing the electronic part to the flat wire through heating.

(24) It is also possible to provide a coil 3 in which features of the above embodiments are combined. For example, a constitution is also possible in which a coil having the shape given in the first embodiment is combined with the sensor given in the sixth embodiment. A person skilled in the art can constitute a coil or reactor by freely combining parts of the features of any of the above embodiments.

What is claimed is:

1. A coil comprises:

a coil unit provided with a wire, a self-melting layer formed on surfaces of the wire, and a resin member affixed to the wire, wherein the wire is a flat wire, the coil unit is an edgewise coil in which the flat wire is wound, the resin member is mounted on an axial-direction end of the coil unit, pressure is applied to the coil unit in the axial direction of the coil unit with the resin member mounted thereon and with the resin member interposed therebetween, the self-melting layer on the surfaces of the flat wire is heated and melts to adhere to adjacent segments of the wound flat wire, a protruding portion that protrudes from the surface of the flat wire is formed on at least one part of the coil unit, and a portion of the protruding portion is adhered to an adjacent segment of the flat wire by the self-melting layer.

2. The coil as claimed in claim 1, wherein the resin member is mounted on both ends of the coil unit.

3. The coil as claimed in claim 1, wherein the protruding portion is crushed by pressure being applied in the axial direction of the coil unit after the flat wire is wound.

4. The coil as claimed in claim 1, wherein the protruding portion is formed on at least one part of an inner circumference of bends in the coil unit, and the protruding portion is crushed by pressure being applied in the axial direction of the coil unit after the flat wire is wound.

5. The coil as claimed in claim 1, wherein the flat wire has a flat surface, the coil unit is formed by winding the flat wire such that the flat surfaces confront one another, and adjacent segments of the flat wire are adhered on at least part of the flat surfaces by the self-melting layer.

6. The coil as claimed in claim 1, wherein the resin member has a through portion for a connection terminal protruding from an end portion of the coil unit.

7. The coil as claimed in claim 1, wherein the resin member has a affixing portion for a core inserted into the coil unit.

8. A reactor comprising a core and the coil as claimed in claim 1, wherein the core is embedded in the resin member, and a positioning portion that positions an end of the coil unit is provided to a surface of the resin member in which the core is embedded.

9. The reactor as claimed in claim 8, wherein the self-melting layer at the end of the wire is adhered to the positioning portion and the wire of the coil unit is affixed to the resin member.

10. A reactor comprising a core and the coil as claimed in claim 1, wherein the core is embedded in the resin member, and the end face of the coil unit is adhered to the resin member by the self-melting layer.

* * * * *